US011504980B2

(12) United States Patent
Mombourquette et al.

(10) Patent No.: US 11,504,980 B2
(45) Date of Patent: Nov. 22, 2022

(54) APPARATUS AND METHODS FOR PROCESSING DIGITALLY PRINTED TEXTILE MATERIALS

(71) Applicant: ColDesi, Inc., Tampa, FL (US)

(72) Inventors: Mark Mombourquette, Treasure Island, FL (US); Brett Weibel, Seminole, FL (US); Scott Colman, Tampa, FL (US)

(73) Assignee: ColDesi, Inc., Tampa, FL (US)

( * ) Notice: Subject to any disclaimer, the term of this patent is extended or adjusted under 35 U.S.C. 154(b) by 115 days.

(21) Appl. No.: 16/700,696

(22) Filed: Dec. 2, 2019

(65) Prior Publication Data

US 2020/0189295 A1 Jun. 18, 2020

Related U.S. Application Data

(60) Provisional application No. 62/779,110, filed on Dec. 13, 2018.

(51) Int. Cl.
*B05B 12/12* (2006.01)
*B05B 13/04* (2006.01)
(Continued)

(52) U.S. Cl.
CPC ..... *B41J 11/0015* (2013.01); *B05B 12/12* (2013.01); *B05B 13/04* (2013.01);
(Continued)

(58) Field of Classification Search
None
See application file for complete search history.

(56) References Cited

U.S. PATENT DOCUMENTS 4,796,046 A * 1/1989 Suzuki ..... G03G 15/2057 219/216
6,755,518 B2 * 6/2004 Codos ..... B41J 11/0015 347/102
(Continued)

FOREIGN PATENT DOCUMENTS

EP 1602497 A2 12/2005
EP 2128330 A1 12/2009
(Continued)

OTHER PUBLICATIONS

European Patent Office; Extended Search Report in related European Patent Application No. 19213610.9 dated Apr. 17, 2020; 13 pages.

*Primary Examiner* — Binu Thomas
(74) *Attorney, Agent, or Firm* — Dorton & Willis, LLP

(57) ABSTRACT

A machine for processing textile substrates includes a base configured to receive a substrate support carrying a textile substrate, and may further include a nozzle assembly supported above the base for applying pretreatment liquid to a pretreatment area of the substrate during relative movement between the nozzle assembly and the substrate support along a conveying direction. A forced air assembly is supported above the base for movement transverse to the conveying direction. A controller that controls the relative movement between the substrate support and the nozzle assembly along the conveying direction, or the movement of the forced air assembly along the second axis based on information related to a pretreatment area or a print area of the textile substrate in order to direct heated air from the forced air assembly onto an area of the textile substrate substantially corresponding to the pretreatment area or the print area.

12 Claims, 8 Drawing Sheets

(51) Int. Cl.

| | |
|---|---|
| ***B05C 5/00*** | (2006.01) |
| ***B05C 5/02*** | (2006.01) |
| ***B05C 9/14*** | (2006.01) |
| ***B41J 11/00*** | (2006.01) |
| ***B41J 3/407*** | (2006.01) |
| ***B41M 5/00*** | (2006.01) |
| ***D06B 1/02*** | (2006.01) |
| ***D06B 19/00*** | (2006.01) |
| ***D06B 5/00*** | (2006.01) |
| ***D06B 15/00*** | (2006.01) |
| ***B05B 15/18*** | (2018.01) |

(52) U.S. Cl.

CPC ..... *B05B 13/0468* (2013.01); *B05B 15/18* (2018.02); *B05C 5/001* (2013.01); *B05C 5/002* (2013.01); *B05C 5/02* (2013.01); *B05C 5/0204* (2013.01); *B05C 5/0216* (2013.01); *B05C 9/14* (2013.01); *B41J 3/4078* (2013.01); *B41J 11/0022* (2021.01); *B41M 5/0011* (2013.01); *D06B 1/02* (2013.01); *D06B 5/00* (2013.01); *D06B 15/00* (2013.01); *D06B 19/0011* (2013.01); *D06B 19/0023* (2013.01)

(56) References Cited

U.S. PATENT DOCUMENTS

| | | | | |
|---|---|---|---|---|
| 7,419,255 | B2 | 9/2008 | Kawaguchi et al. | |
| 10,189,277 | B2 | 1/2019 | Schiestl | |
| 2003/0016269 | A1* | 1/2003 | Sekiya | B41J 2/155 347/42 |
| 2004/0189769 | A1* | 9/2004 | Wilbur | B41J 11/002 347/102 |
| 2004/0239705 | A1* | 12/2004 | Arikita | B41J 3/4078 347/5 |
| 2005/0270361 | A1* | 12/2005 | Lee | B41J 3/4078 347/212 |
| 2007/0019050 | A1* | 1/2007 | Lim | B41J 11/002 347/102 |
| 2009/0293209 | A1* | 12/2009 | Chung | B41J 3/4078 347/21 |
| 2010/0079532 | A1* | 4/2010 | Nishimura | B41J 11/06 347/16 |
| 2012/0176435 | A1* | 7/2012 | Yamanobe | B41J 11/00212 347/16 |
| 2014/0020189 | A1* | 1/2014 | Weibel | B41J 3/4078 8/499 |
| 2015/0273866 | A1* | 10/2015 | Sakai | B41J 3/4078 347/21 |
| 2015/0296095 | A1* | 10/2015 | Kawafuji | H04N 1/00801 358/474 |
| 2017/0015113 | A1* | 1/2017 | Yamashita | B41J 3/4078 |
| 2018/0207954 | A1* | 7/2018 | Schiestl | B41J 11/0015 |
| 2019/0009575 | A1 | 1/2019 | Mombourquette et al. | |
| 2019/0381808 | A1* | 12/2019 | Friedrich | B41J 3/4078 |
| 2020/0016913 | A1* | 1/2020 | McFarlane | B41J 3/4078 |

FOREIGN PATENT DOCUMENTS

| | | | |
|---|---|---|---|
| EP | 3121016 | A1 | 1/2017 |
| GB | 2560327 | A | 9/2018 |
| JP | 2005035047 | A | 2/2005 |
| WO | 2015146182 | A1 | 10/2015 |

* cited by examiner

APPARATUS AND METHODS FOR PROCESSING DIGITALLY PRINTED TEXTILE MATERIALS

CROSS-REFERENCE TO RELATED APPLICATIONS

This application claims the benefit of priority to U.S. Provisional Patent Application Ser. No. 62/779,110, filed Dec. 13, 2018, the disclosure of which is incorporated by reference herein in its entirety

TECHNICAL FIELD

The present invention relates generally to direct-to-garment printing and, more particularly, to support equipment for applying pretreatment liquids to textile materials and drying or curing liquids and inks applied to textile materials.

BACKGROUND

Direct-to-garment printing is a popular technique for providing garments with graphics, designs, and other decoration. In a typical direct-to-garment printing operation, a printing system is used to dispense inks directly onto a garment. Pre-treatment solutions have been developed that improve the visual appearance of the decoration provided by the printing operation. In particular, pre-treatment solutions can be applied to a garment before the printing operation, and then the ink is applied onto the garment having the pretreatment solution during a printing operation.

Digitally printed fabrics and textiles used with direct-to-garment printing equipment desirably have an applied coating of translucent pretreatment liquid that creates a controlled printing surface which performs various functions. The pretreatment liquid produces a coating on the garment fabric which enhances color intensity and increases pigment bonding to the fabric which optimizes the printed image. Most conventional inkjet printers used for printing onto textiles and that apply a pretreatment prior to printing require the pretreatment coating to be dry before printing the ink layers.

Typically, the pretreatment, printing, and curing cycles are each performed using dedicated, individual pieces of equipment designed to perform each of the processes singularly. The steps of producing a printed garment generally involve handling the garment to be printed by passing it from a pretreat machine, to a dryer or heat press, then onto a printer and again on to another heat press or dryer for the ink to be cured as the final step in the process. The final step after printing requires a drying and curing process that binds the pretreatment and ink layers into the textile, thereby fixing the pretreatment/ink layer permanently to maintain the color intensity and wash fastness.

Generally, the pre- and post-printing process steps require multiple pieces of equipment that perform applying the pretreatment liquid, drying the pretreatment before printing, and then curing the ink on the textile post printing using a heat press or conveyor oven.

Pretreat machines typically use standard off-the-shelf spray systems that apply the pretreatment liquid to the fabric. These spray systems generally include a solenoid valve having a spray tip fastened to its output. When the solenoid is activated, a pressurized fluid is supplied to the nozzle tip such that a fanned spray pattern is developed. This fanned spray pattern usually produces extremely small liquid droplets that are mist-like in nature. A common problem that these spraying systems have is that overspray and excessive misting can be carried into the environment surrounding the pretreat machine during the spray application, thereby coating the machine parts and surroundings with pretreatment liquid. Many conventional machines attempt to contain this excessive misting by enveloping the machine spray area in an enclosure to contain the overspray. Another common problem with conventional spraying systems is that uneven spray patterns result when a stationary nozzle lays down drops of pretreatment liquid that are heavier in certain areas of its fan pattern and lighter in other areas. A result of the issues discussed above is that conventional pretreatment spraying equipment machines are generally very inefficient and wasteful.

After the pretreatment has been applied, the garment must be dried to remove any moisture or water content that was added to the garment during application of the pretreatment liquid. To accomplish this, the garment is typically moved or transferred to a drying source, typically a heat press or dryer oven. Using a heat press to dry or cure the garment is inefficient due to the enclosed nature of the process. The garment is placed on a support surface and a heated upper plate is lowered until it physically touches and clamps down on the garment. This action encapsulates the garment to evaporate the water and dry the garment fabric. The enclosed nature of this drying process encapsulates water vapor and steam during the drying process, so that it cannot easily escape from the body of the garment. Moreover, because there is no airflow in these heat press systems, the steam gets trapped in the garment and affects the quality of the preprinted garment. Heat press operations can also be ergonomically challenging. The upper heated plate of the press must continuously remain at a desired set point regardless of whether the press is being used or not, which thereby heats the ambient air in the room. By design, the heated plate must contact (press) the fabric, which has an adverse effect on some fabric materials by leaving a press mark that is indicated by discoloration of the textile in the area of contact. Some heat press manufacturers include a non-contact "hover" feature intended to help prevent press marks by slightly pre-drying the garment before pressing. However, the hover cycle does not promote efficient heat transfer to the garment, which adds additional time and another process step in the press cycle. The problem of trapped moisture in the garment is well known in the heat press industry. There have been various efforts to combat this issue using support pads of different designs and materials to provide an escape path for the water vapor, however, current resolutions are still ineffective at best. Another problem of using a heat press to dry pretreat liquids is that a pretreat coating tends to build up onto the heated upper plate surface and constantly requires the operator to wipe the off the hot plate.

Another method of drying pretreated garments or curing ink is the use of heat tunnels or conveyor ovens. This non-contact drying technique overcomes the problems of press marks and moisture trapping typical of heat press operations, and is generally more efficient at removing moisture. Accordingly, heat tunnels or conveyor ovens can dry or cure garments more effectively. Dryer tunnels are mostly used in larger printing facilities, due to their large size, high upfront cost, and heavy power requirements. In addition, the non-contact heating action of heat tunnels and conveyor ovens tend to require more energy and longer times to dry or cure a garment, compared to contact-type heat press systems. Heat tunnel systems use a porous mesh conveyor belt to transfer garments through the tunnel. The dryers usually incorporate a combination of passive heating elements and infra-red drying lamps along with convection airflow systems to decrease the drying or cure cycles. Most tunnel dryers provide a heat escape air vent that must be vented outside the building, especially when burning natural gas as a heat source. Since the conveyor belt moves the garment through the enclosed tunnel at a fixed speed, the omni-directional heat by nature applies heat to the entire garment, thereby increasing the amount of energy required for drying or curing. More elaborate tunnel dryer systems may use sensors to detect the presence or shape of a garment, and attempt to turn on and modulate certain heating elements within the heat chamber as the garment passes through it. Multiple heating elements are required along the entire length and width of the tunnel, and these must be at least as wide as the largest garment. The use of multiple heating elements increases machine costs and complexity, and raises the amount of power required since energy is used to heat the entire chamber, the entire garment, and the pretreated or printed area. The inefficiency is evident in that the heat generated is not focused solely on the printed or treated areas of a garment. Since all these dryers use an open belt to transfer the garment through the heat chamber, air flow produced inside the chamber to facilitate drying is mostly flowing around the garment, which yields less than ideal drying effectiveness. This is apparent in the extended amount of time that it takes to dry the garment when using a heat tunnel system. Even after a pretreated garment is dried using a tunnel dryer or conveyor oven, the garment generally must undergo another step to flatten out vertical surface fibers of the garment using a heat press before printing, therefore requiring another step in the printing process.

Another inefficiency of both heat press systems and tunnel or conveyor driers is that, by design, heat is applied to a fixed area of the garment and cannot be adjusted based on the actual amount of heat needed for drying or curing. For example, both heat press systems and tunnel or conveyor driers heat the same amount of area on a garment regardless of whether the area that actually needs to be dried is 16 square inches or 120 square inches. In other words, these systems cannot focus heat onto areas only where it is needed. This creates waste by heating areas of the garment which do not require heat, and can slow the process of curing large numbers of garments. The throughput of product on a conveyor that is dictated by the size of the product and not the size of the needed heat area is wasteful and counterproductive. In one aspect of the proposed invention, heat is focused only where there has been pretreat fluid sprayed or ink printed and therefore maximizes efficiencies. Thus, it will take less time and energy to dry/cure a smaller area than it will to dry/cure a larger area.

A need exists for improved apparatus and methods to effectively dry pretreated garments and cure printed garments that overcome these and other drawbacks of conventional systems and methods.

SUMMARY

The present invention provides a machine for processing textile substrates used in digital printing operations, whereby pretreatment liquid may be applied to textile substrates and dried prior to receiving printing inks. The machine may also be used to cure inks that have been applied to textile substrates. In one aspect, the machine includes a base configured to receive a substrate support that carries a textile substrate, and a nozzle assembly supported above the base for applying pretreatment liquid to a pretreatment area of the textile substrate. A conveying actuator imparts relative movement between the nozzle assembly and the substrate support along a first axis aligned with a conveying direction of the machine, and a forced air assembly is supported above the base for movement along at least one second axis transverse to the conveying direction. The machine further includes a controller that controls the relative movement between the substrate support and the nozzle assembly along the conveying direction, or the movement of the forced air assembly along the second axis based on information related to a pretreatment area or a print area of the textile substrate to direct heated air from the forced air assembly onto an area of the textile substrate substantially corresponding to the pretreatment area or the print area.

In another aspect, a method of processing textile substrates in a digital printing operation includes supporting a textile substrate on a substrate support, directing heated air from a forced air assembly toward the textile substrate, and controlling movement of the forced air assembly relative to the textile substrate such that the heated air is applied to an area of the textile substrate substantially corresponding to at least one of a pretreatment area or a print area. The method may further include detecting a characteristic of the textile substrate related to a moisture level of the pretreatment area, and controlling movement of the forced air assembly based on the detected characteristic.

The above and other objects and advantages of the present invention shall be made apparent from the accompanying drawings and the description thereof.

DETAILED DESCRIPTION

Figure 1:
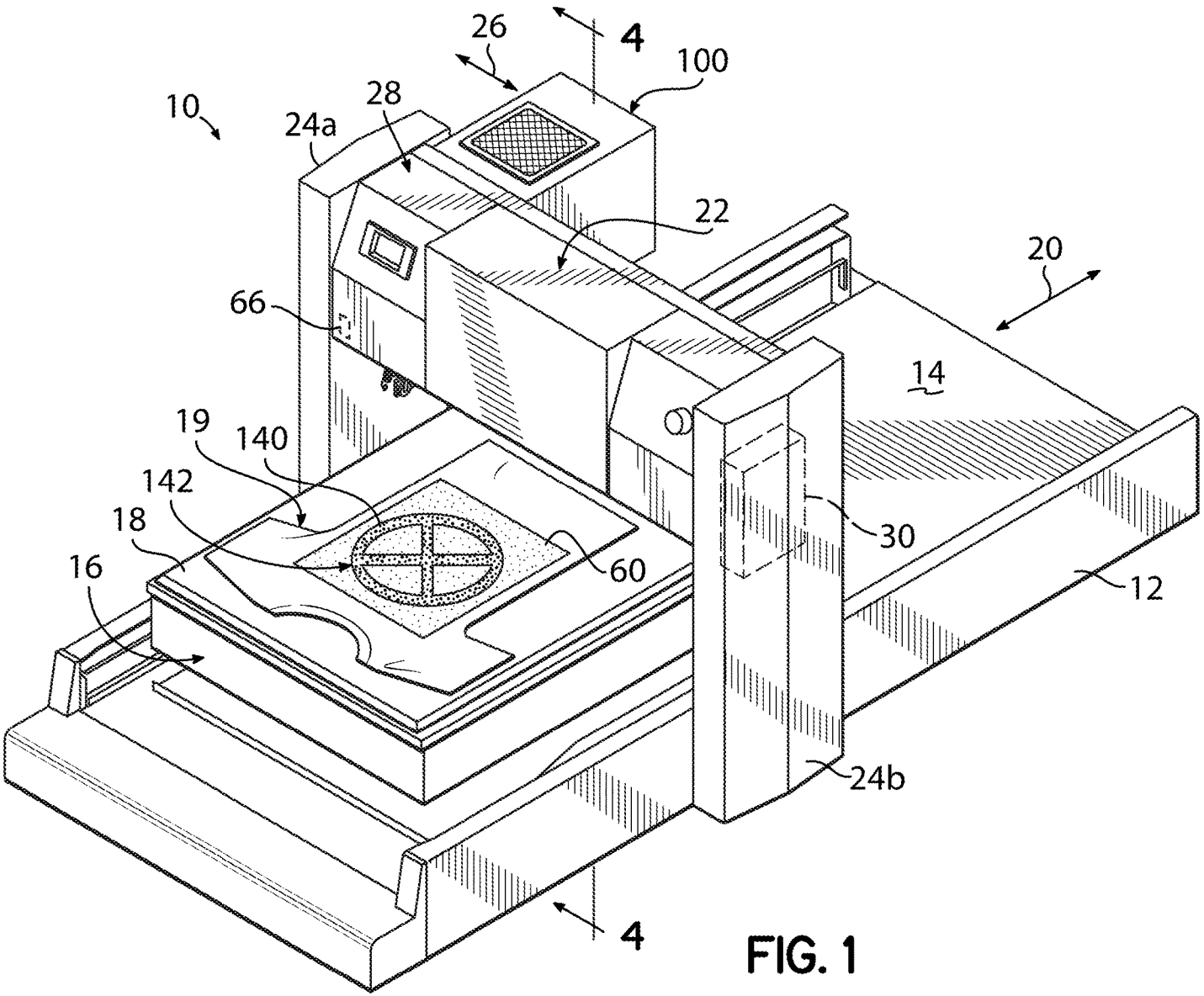
FIG. 1 is a perspective view of an exemplary machine for processing textile substrates in accordance with the principles of the present disclosure.

FIG. 1 depicts an exemplary machine 10 for processing textile substrates that will receive printing from direct-to-garment printing equipment in accordance with the principles of the present disclosure. The machine 10 includes a base 12 having a bed 14 configured to receive a substrate carrier 16, such as a platen assembly, that supports textile substrates during the application of treatment liquids and/or printing inks. In the embodiment shown, the platen assembly 16 includes a substrate support 18 upon which the textile substrate 19 is placed, and the machine 10 is configured to move the platen assembly 16 along the bed 14 in a direction parallel to a conveying axis 20 of the machine 10. The machine 10 further includes a header assembly 22 supported above the base 12 by a pair of vertical posts 24*a*, 24*b* positioned on opposite sides of the bed 14. The header assembly 22 extends between the posts 24*a*, 24*b* parallel to a second axis 26 that is transverse to the conveying axis 20. The header assembly 22 includes a header enclosure 28 that houses various components of the machine 10. The machine 10 further includes a controller 30 that communicates with various sensors and actuators of the machine 10 and is configured to control operation of the machine 10 as will be described in more detail hereinbelow. In the embodiment shown, the controller 30 is supported in one of the posts 24*b*, however, it will be appreciated that the controller 30 may alternatively be located in various other parts of the machine 10, and may alternatively comprise two or more control modules cooperating to control operation of the machine 10.

Figure 2:
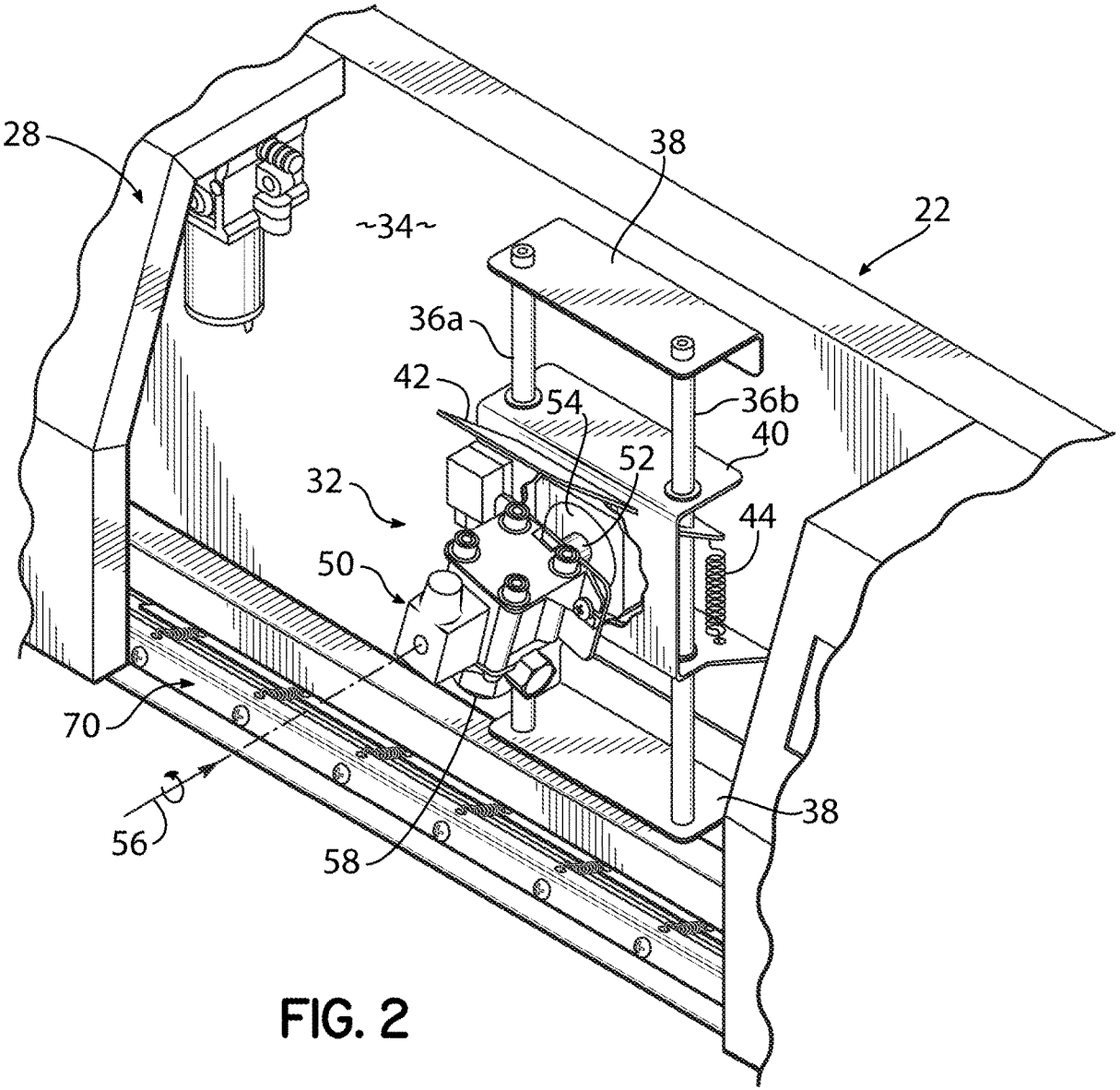
FIG. 2 is an enlarged detail view depicting a nozzle assembly of the machine of FIG. 1.
Figure 3A:
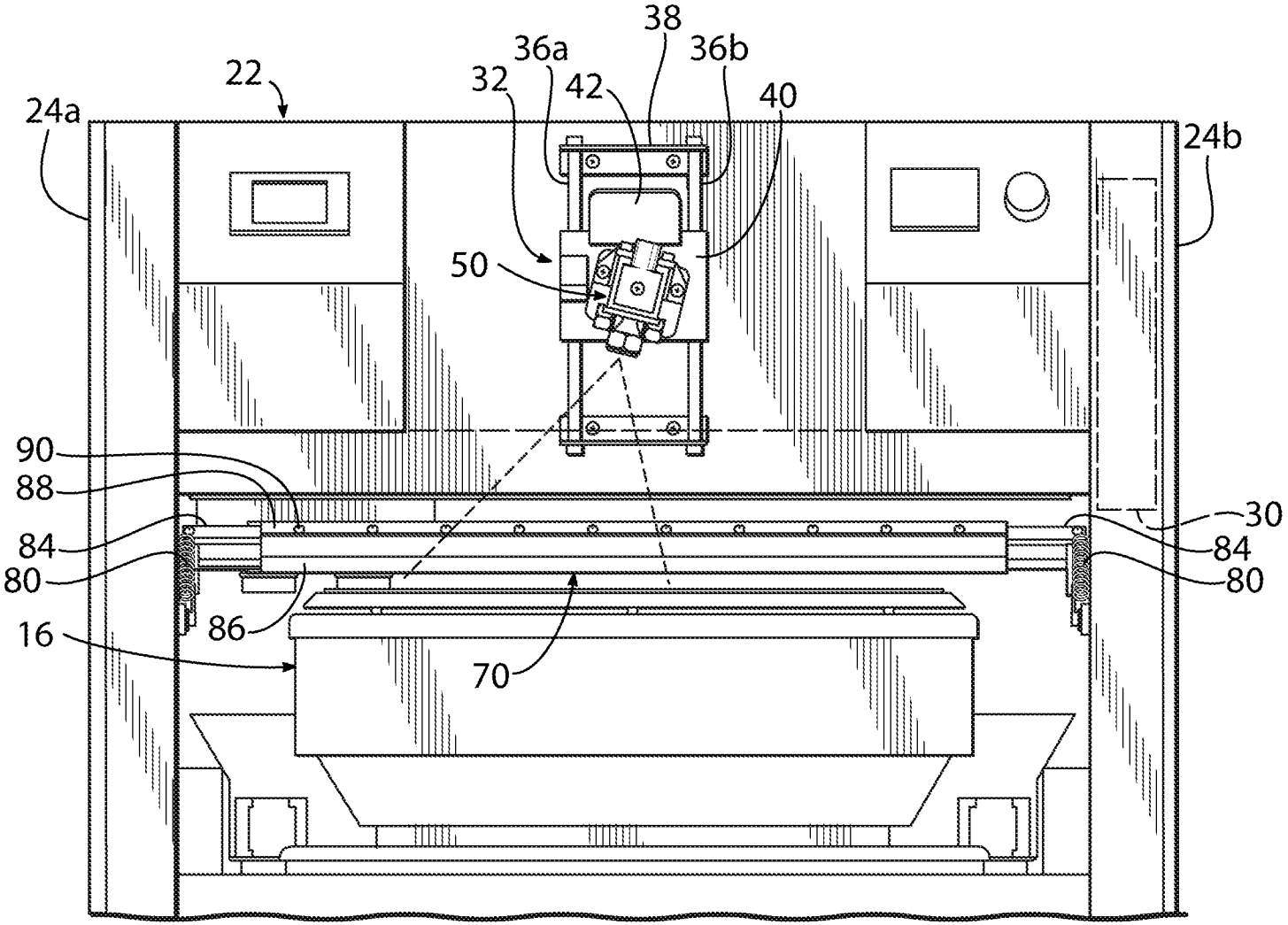
FIGS. 3A-3B are detail front views of the machine of FIG. 1, illustrating operation of the nozzle assembly.
Figure 3B:
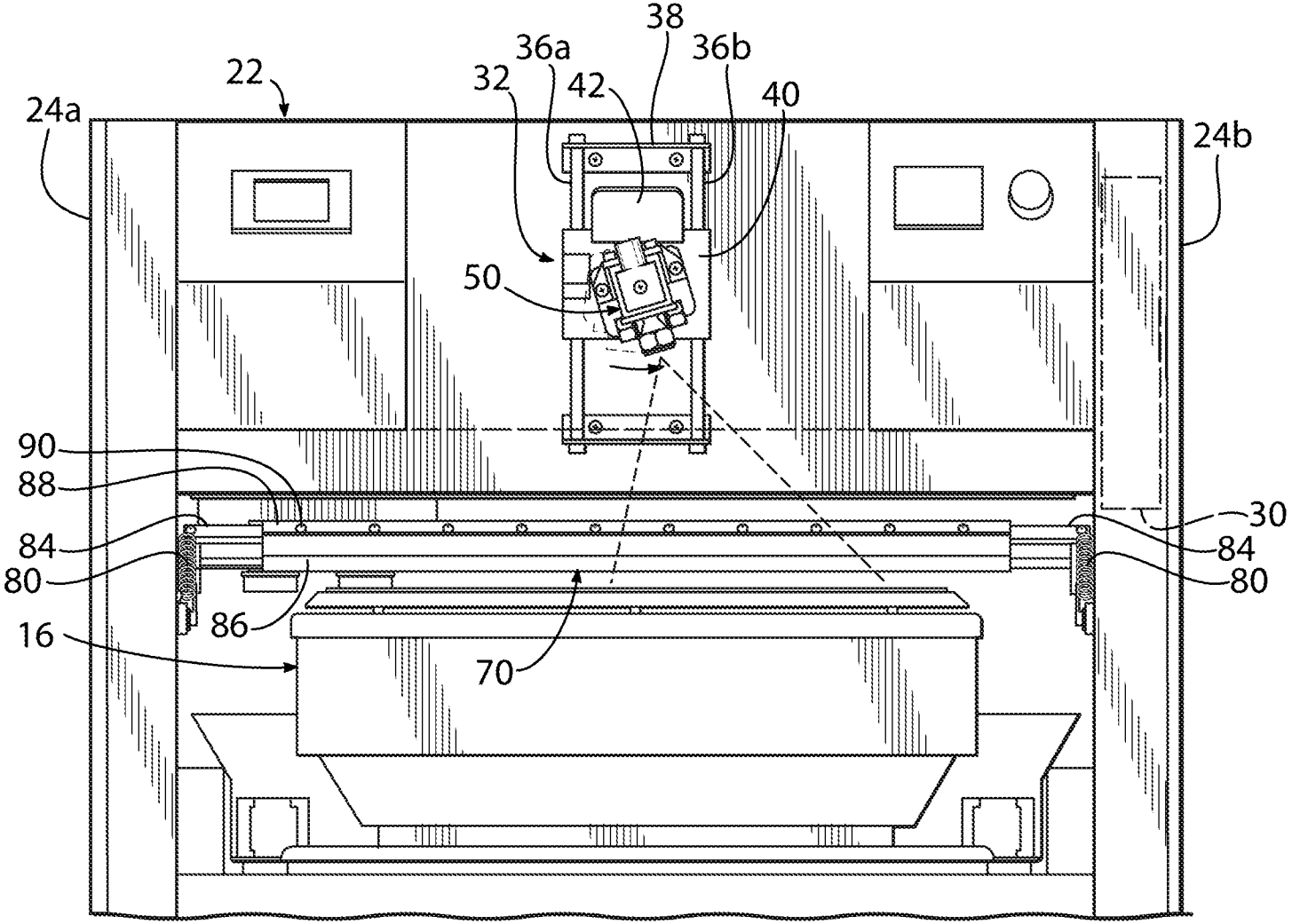

With continued reference to FIG. 1, and referring further to FIGS. 2, 3A, and 3B, the machine 10 may further include a nozzle assembly 32 supported on the header assembly 22 and positioned above the bed 14, whereby pretreatment liquid may be dispensed from the nozzle assembly 32 to a textile substrate 19 as the textile substrate 19 is moved beneath the nozzle assembly 32 carried on the platen assembly 16 moving along the bed 14 in directions parallel to the conveying axis 20. The platen assembly 16 is moved along the bed 14 of the machine 10 by actuators operating under the control of the controller 30. While the embodiment shown and described herein includes a platen assembly 16 that is moved along the base 12 to impart relative motion between a generally fixed nozzle assembly 32 and a textile substrate 19 carried on the substrate support 16, it will be appreciated that in other embodiments, relative movement may be achieved by moving the nozzle assembly 32 along a conveying direction relative to a stationary substrate support 18, such as by a header assembly 22 that is carried by movable posts 24*a*, 24*b*.

With continued reference to FIGS. 2, 3A, and 3B, the nozzle assembly 22 of the embodiment shown is supported on a back wall 34 of the header enclosure 28 by first and second vertical rods 36*a*, 36*b* secured to the back wall 34 by mounting brackets 38. A nozzle support bracket 40 is slidably coupled with the first and second vertical rods 36*a*, 36*b* whereby a vertical position of the nozzle assembly 32 relative to the base 12 may be selectively adjusted. The first and second vertical rods 36*a*, 36*b* pass through an adjustment lever 42 that is pivotally coupled with the nozzle support bracket 40 whereby the vertical position of the support bracket 40 and the nozzle assembly 32 may be adjusted by moving the adjustment lever 42 against the bias of tension springs 44 so that sliding movement of the nozzle support bracket 40 along the vertical rods 36*a*, 36*b* is permitted. When the desired vertical position of the nozzle assembly 32 is attained, the adjustment lever 42 may be released, whereby the tension springs 44 bias the adjustment lever 42 to a position that effectively clamps the nozzle support bracket 40 against further movement. While the nozzle assembly 32 is shown and described herein as being configured for manual adjustment of a vertical position relative to the base 12, it will be appreciated that the nozzle assembly 32 may alternatively be configured for automated adjustment of the relative vertical position using appropriate actuators controlled by the controller 30.

In this embodiment, the nozzle assembly 32 comprises a solenoid-actuated nozzle body 50 supported on an output shaft 52 of a stepper motor 54 carried by the nozzle support bracket 40. Actuation of the stepper motor 54 by the controller 30 causes a pivotal movement of the nozzle body 50 about a pivot axis 56 of the output shaft 52 which is aligned substantially parallel to the conveying axis 20. Actuation of the stepper motor 54 may be controlled to impart an oscillatory motion to the nozzle body 50, whereby a spray pattern emanating from the nozzle outlet 58 may be moved side to side along directions transverse to the conveying axis 20 as depicted in FIGS. 3A-3B. As the spray pattern oscillates side to side by the pivotal movement of the nozzle body 50, liquid pretreatment material deposited on a textile substrate 19 moving beneath the nozzle assembly 32 is applied in a generally rectangular pattern on the textile substrate, and edges of this pretreatment area 60 on the textile substrate 19 receive less liquid pretreatment such that the resulting pretreatment area 60 has "soft" side edges.

While not illustrated in this embodiment, the nozzle body 50 may also be configured for pivotal movement by an appropriate actuator, such as a stepper motor, about an axis that is generally transverse to the conveying axis 20. Pivotal movement of the nozzle body 50 in this manner ensures a more even fill of pretreatment liquid dispensed to the textile substrate 19. The controller 30 may actuate the movement of the nozzle body 50 in cooperation with actuation of the solenoid based on the relative vertical position of the nozzle assembly 32 above the base 12 and the speed of relative movement between the nozzle assembly 32 and a textile substrate 19 on the substrate support 18.

In some embodiments, the machine 10 may further include a color detection sensor 66 supported above the base 12, such as on the header assembly 22, and configured to detect a color of a textile substrate 19 carried on the substrate support 18. Information from the color detection sensor 66 related to the color of the textile substrate 19 may be used by the controller 30 to determine a type of pretreatment liquid to be applied to the textile substrate 19. An exemplary color detection sensor 66 that may be used with machine 10 is Color Light-to-Digital Converter with IR Filter model number TCS3472, available from Taos, Inc. of Plano, Tex. The color detection sensor 66 may also be used in connection with detection of printed indicia 140 on the textile substrate 19, as discussed below.

In one embodiment, the textile substrates 19 processed by the machine 10 disclosed herein may be supported on a vacuum platen assembly, such as the platen assembly disclosed in U.S. Patent Application Publication No. 2019/0009575, wherein the platen assembly is configured to draw the textile substrate 19 against the substrate support surface 18 using vacuum pressure. When such a vacuum platen assembly is used to support textile substrates 19, a very high static pressure vacuum may be developed during the application of pretreatment liquid to the textile substrate 19, whereby air flowing through the textile substrate 19 pulls the pretreatment liquid onto the garment and reduces or eliminates misting or overspray of the pretreatment liquid.

Figure 4:
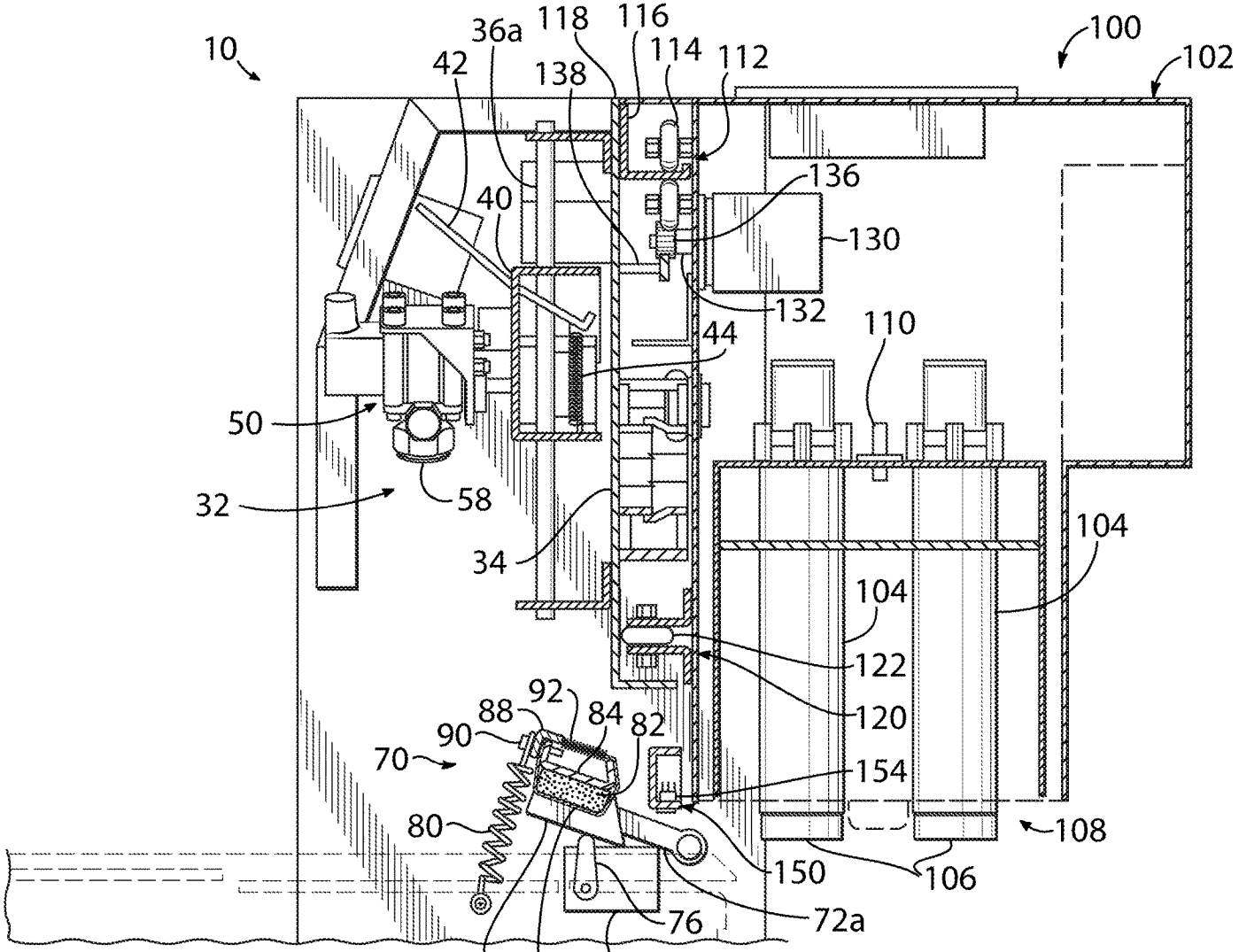
FIG. 4 is a partial cross-sectional view taken along line 4-4 of FIG. 1.
Figure 5:
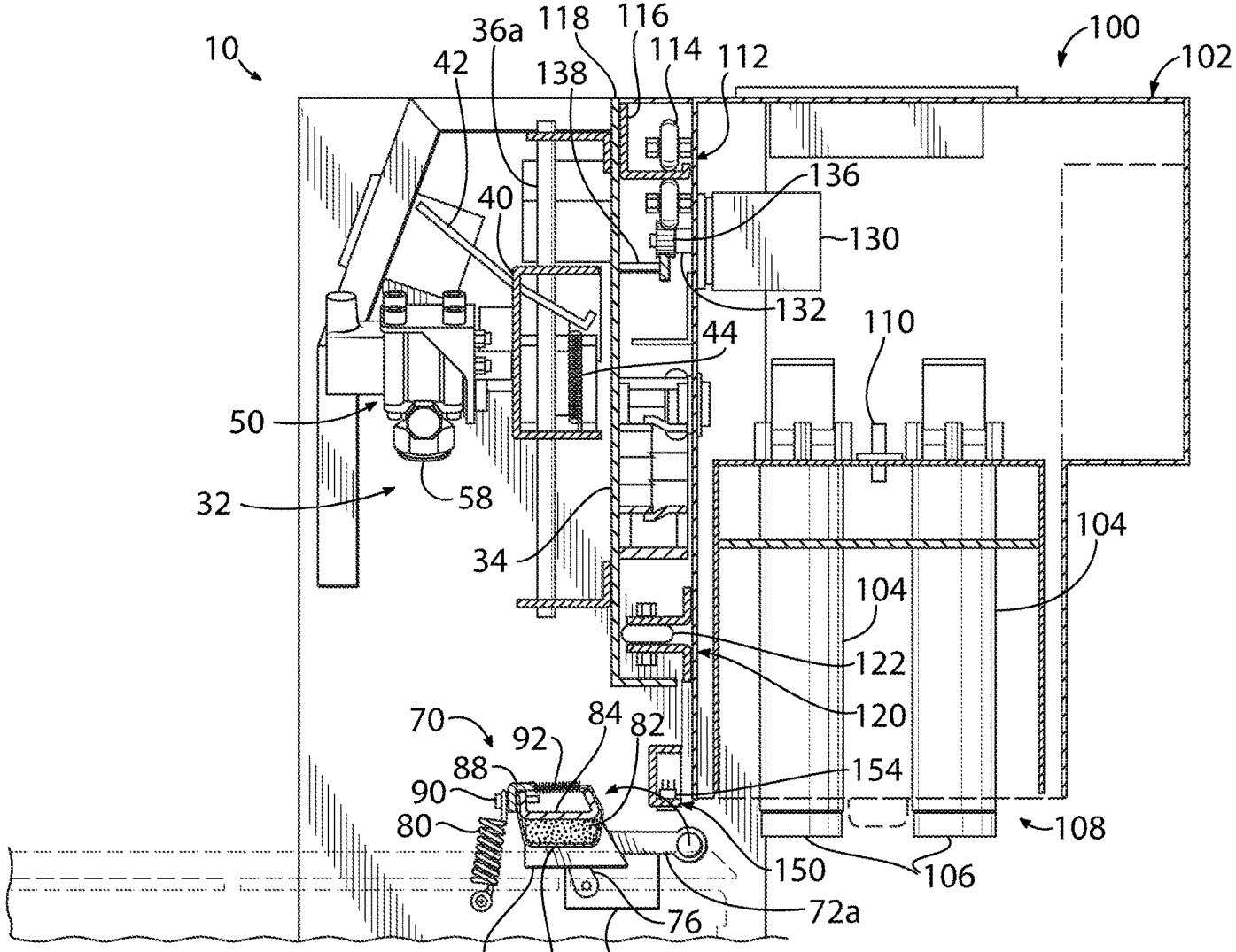
FIG. 5 is a partial cross-sectional view similar to FIG. 4, depicting an exemplary tamp bar assembly in an alternate position.

With continued reference to FIG. 1, and referring further to FIGS. 4 and 5, the machine 10 further includes a tamping bar assembly 70 extending between the first and second vertical posts 24*a*, 24*b*. The tamping bar assembly 70 is positioned at a location behind the nozzle assembly 32 with respect to a conveying direction of the machine 10, and is pivotally supported on the posts 24*a*, 24*b* by first and second pivot arms 72*a*, 72*b* for movement between a first position wherein the tamping bar assembly 70 engages a textile substrate 19 supported on the substrate support 18, and a second position wherein the tamping bar assembly 70 is spaced a distance above the textile substrate 19. In the embodiment shown, a lift motor 74 is supported on one of the vertical posts 24*a* and has a lever arm 76 supported on an output shaft of the lift motor 74. The lift motor 74 operates under the control of the controller 30 and moves the lever arm 76 for engagement with a lift block 78 coupled to the tamping bar assembly 70, whereby the tamping bar assembly 70 may be moved between the first and second positions. The tamping bar assembly 70 may be biased in a direction toward the first position by one or more springs 80 coupled between the tamping bar assembly 70 and a vertical post 24*a*, 24*b* or other structure of the machine 10.

In the embodiment shown, the tamping bar assembly 70 includes an elongate foam member 82 secured to a lower portion of the tamp bar 84. In one embodiment, the foam member 82 may be an ultra-soft, open cell foam. The tamping bar assembly 70 may further include a film sheet 86 secured to the tamp bar 84 and extending beneath the elongate foam member 82. In the embodiment shown, the film sheet 86 is secured near a front edge of the tamp bar 84 by a clamp bracket 88 that is attached to the tamp bar 84 by a plurality of fasteners 90. The film sheet 86 extends from the clamp bracket 88, beneath the foam member 82, and around a rearwardly facing side of the tamp bar 84. The second side of the film sheet may be secured to the clamp bracket 84, for example, by a plurality of tensile springs 92 whereby the film sheet 86 is kept under tension against the foam member 82. In one embodiment, the film sheet 86 may comprise TEFLON® film that facilitates smooth sliding of the tamping bar assembly 70 over a substrate supported on a platen moving beneath the tamping bar assembly 70. In one embodiment, the foam member 82 is a ⅜-inch thick ultra soft open cell polyurethane foam strip, and the film sheet 86 is a 0.002-inch-thick sheet of TEFLON® material.

In operation, the tamping bar assembly 70 is moved from the second position spaced above a textile substrate 19 supported on the platen assembly 16 toward the first position as the platen assembly 16 moves beneath the tamping bar assembly 70 so that the tamping bar assembly 70 engages the textile substrate 19. As the textile substrate 19 supported on the platen assembly 16 continues to move along the bed 14 in the conveying direction, the foam member 82 conforms to the surface of the textile substrate 19 and effectively applies a constant, uniform pressure to the surface of the textile substrate 19 that smooths the surface of the textile substrate 19 and removes any ripples or puckers. In addition, the tamping bar assembly 70 flattens down and smooths the textile fibers immediately following the application of pretreatment liquid by the nozzle assembly 32, such that any vertically extending surface fibers are laid down in a common direction for improved printing of the textile substrate 19 with inks in a subsequent process.

Figure 6:
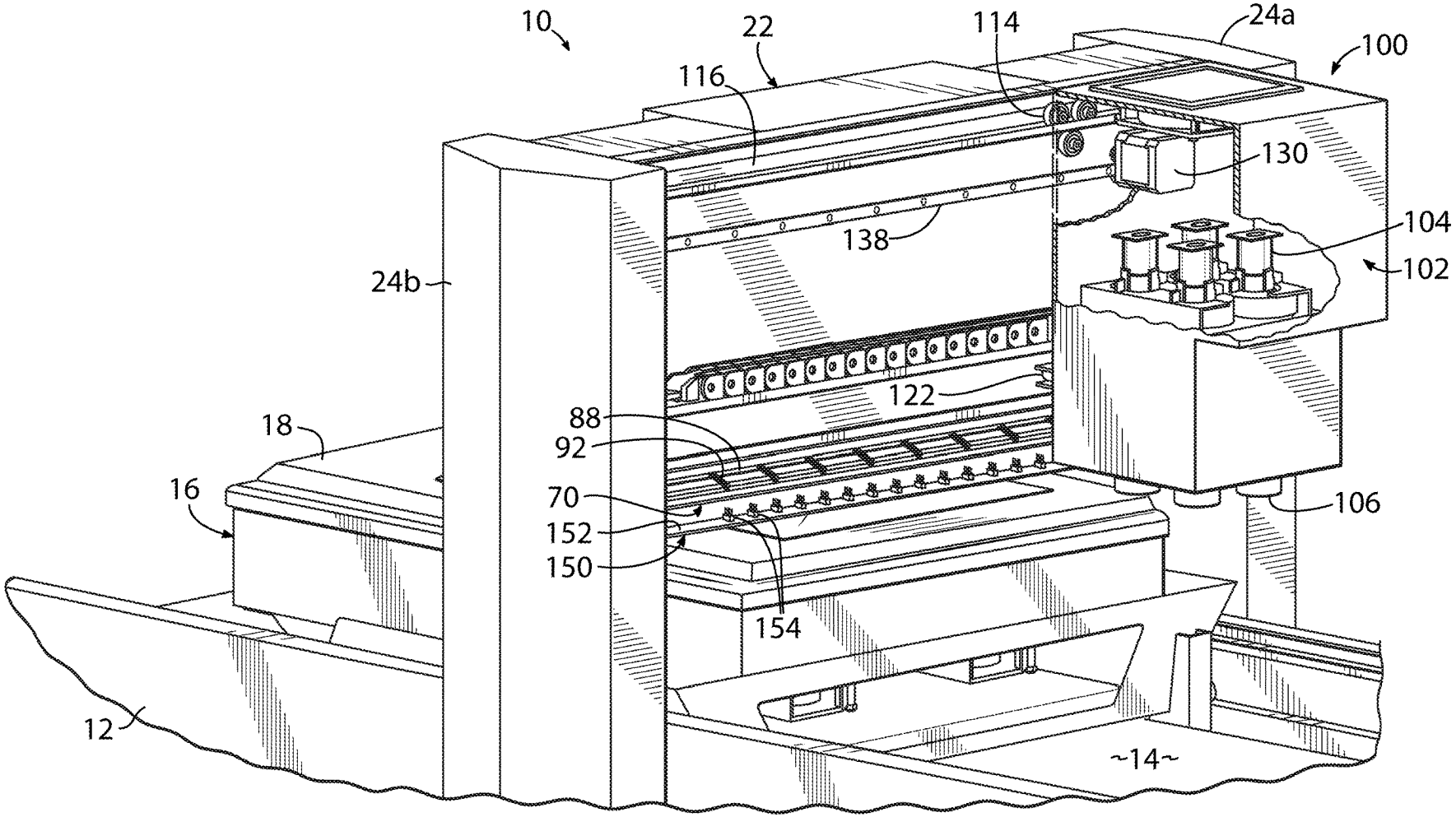
FIG. 6 is a rear perspective view of the machine of FIG. 1 with features removed to illustrate detail.
Figure 7:
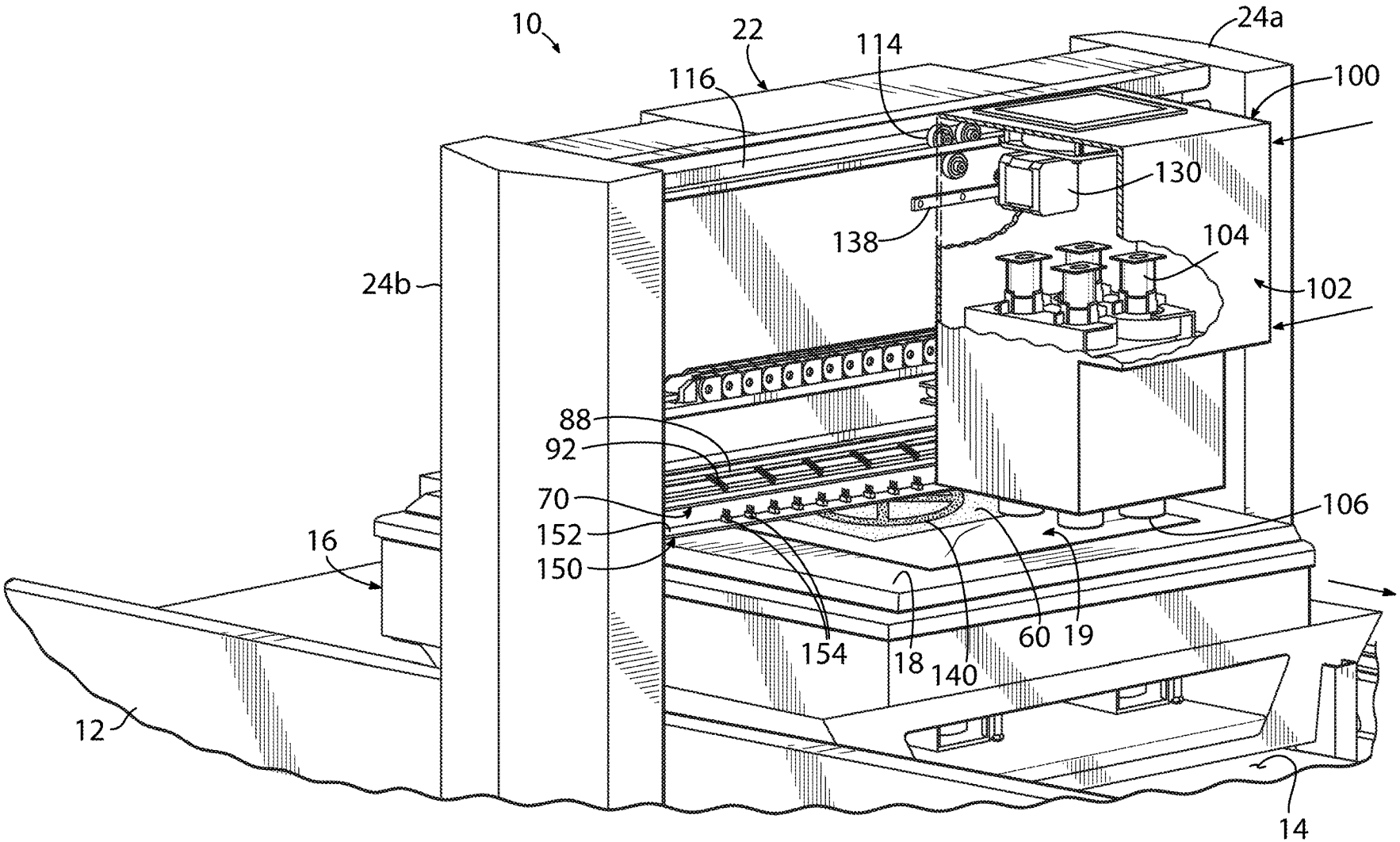
FIG. 7 is a rear perspective view similar to FIG. 6, depicting an exemplary forced air assembly in a different position.

With continued reference to FIGS. 4-5, and referring further to FIGS. 6-7, the exemplary machine 10 further includes a forced air assembly 100 supported above the base 12 and mounted on the header assembly 22 for movement in directions parallel to an axis 26 that is transverse to the conveying axis 20 of the machine 10. As depicted in FIGS. 6 and 7, the forced air assembly 100 comprises an enclosure 102 that houses the components for drying a textile substrate 19 after pretreatment liquid has been applied and the substrate 19 has been tamped as described above. In the embodiment shown, the forced air assembly 100 includes four heat guns 104 mounted within the enclosure 102, with outlet ends 106 of the heat guns 104 facing the open, bottom end 108 of the enclosure 102 to thereby direct heated air toward a textile substrate 19 supported on the platen assembly 16 as the platen assembly 16 moves beneath the forced air assembly 100 in directions parallel to the conveying axis 20. While the exemplary embodiment includes four heat guns 104 for directing hot air toward a textile substrate 19, it will be appreciated that a single heat gun 104 may alternatively be used, or various other numbers of heat guns 104 may be used, as may be suitable for drying a pretreated textile substrate 19.

The forced air assembly 100 further includes one or more sensors 110 disposed within the enclosure 102 and positioned and arranged to sense a characteristic of the textile substrate 19 supported on the platen assembly 16 which is related to a moisture level of the textile substrate 19 in the pretreatment area 60. In one embodiment, the sensors 110 may be configured as temperature sensors such as, for example, non-contact infrared temperature sensors. An exemplary temperature sensor 110 that may be used with the forced air assembly 100 is infrared digital temperature sensor model number MLX90614ESF-ACF-000-SP, available from Melexis Technologies NV of Novi, Mich. Because there is a direct correlation between the surface temperature of the textile substrate 19 and the amount of moisture content remaining in the textile substrate 19, the moisture content of the textile substrate 19 can be derived by reading an instantaneous surface temperature of the textile substrate 19. Information related to the sensed moisture content of the textile substrate 19 may then be provided to the controller 30, whereby the controller 30 may then control at least one of the relative movement between the platen assembly 16 and the nozzle assembly 32 along the conveying direction 20, or the movement of the forced air assembly 100 along an axis 26 transverse to the conveying direction 20 so that heated air is directed to those portions of the textile substrate 19 having a higher moisture content. By controlling the movement of the forced air assembly 100 based on the moisture content of the pretreatment area 60, more efficient and timely drying of the pretreated textile substrate 19 is achieved. Moreover, the forced air assembly 100 may be operated such that the heat guns 104 are operated at full power and movement of the forced air assembly 100 relative to the pretreatment area 60 dries the textile substrate 19.

In the embodiment shown, the forced air assembly 100 includes an upper roller assembly 112 with one or more rollers 114 engaged with a roller track 116 that is fixed near an upper edge 118 of the header assembly 22 to facilitate rolling movement of the forced air assembly 100 in directions transverse to the conveying axis 20. The forced air assembly 100 may further include a lower roller assembly 120 which includes one or more rollers 122 configured to engage the back wall 34 of the header assembly 22. The forced air assembly 100 further includes a drive motor 130 that is configured for actuation and control by the controller 30 to thereby move the forced air assembly 100 along directions transverse to the conveying axis 20. In the embodiment shown, the output shaft 132 of the drive motor 130 extends through an aperture 134 in the forced air assembly enclosure 102 and supports a pinion gear 136 for engagement with a corresponding rack gear 138. The rack gear 138 is secured to the back wall 34 of the header assembly 22 and is substantially aligned with the roller track 116 for the forced air assembly 100. Actuation of the drive motor 130 under the control of the controller 30 turns the pinion gear 136 to move along the rack gear 138 whereby the forced air assembly 100 is moved along the roller track 116.

After a textile substrate 19 has been pretreated and dried using the machine 10, the textile substrate 19 may then be removed from the machine 10 to receive inks in order to create various indicia such as words or images in a digital printing process. After the inks have been applied, the textile substrate 19 may be returned to the machine 10 for curing of the applied inks. In one embodiment, the platen assembly 16 that supported the textile substrate 19 during the application of pretreatment liquids and drying of the pretreatment area 60 may be used to transport the textile substrate 19 and receive the digitally printed inks, and subsequently returned to the machine 10 for curing of the inks. Advantageously, the forced air assembly 100 is also configured to cure inks applied to the textile substrate 19. Information regarding the location of the printed indicia may be used by the controller 30 to control relative movement between the platen assembly 16 and the header assembly 22 and/or movement of the forced air assembly 100 in directions transverse to the conveying axis 20 so that heated air is directed only to those portions of the textile substrate 19 containing printed indicia, in a manner similar to that discussed above with respect to drying the pretreatment area 60.

In one embodiment, information regarding the location of the printed indicia 140 in a print area 142 on the textile substrate 19 may be imported into the controller 30 from an external device. In another embodiment, the machine 10 further includes an image sensor assembly 150 supported above the bed 14 and configured to detect indicia 140 applied to a textile substrate 19 supported on the platen assembly 16 during relative movement between the platen assembly 16 and the image sensor assembly 150. In the embodiment shown, the image sensor assembly 150 comprises a sensor support bar 152 disposed beneath the header assembly 22 and positioned behind the tamping bar assembly 70 with respect to a conveying direction 20 of the machine 10. A plurality of image sensors 154 are positioned along the length of the sensor support bar 152 to thereby detect the printed indicia 140 on the textile substrate 19 as the textile substrate 19 passes beneath the sensor support bar 152. In this embodiment, the image sensors 154 may be non-contact reflectance sensors configured to detect light reflected from the textile substrate 19 whereby the location of the printed indicia 140 may be obtained. An exemplary image sensor 154 that can be used with the machine 10 is Reflectance Sensor model number QTR-MD-01RC, available from Pololu Corporation of Las Vegas, Nev. Alternatively, or additionally, the color detection sensor described above with respect to operation of the nozzle assembly 32 may be used to detect the location of printed indicia 140 on a textile substrate 19.

Information related to the location of the printed indicia 140 is communicated to the controller 30, and is used by the controller 30 to control the relative movement of the platen assembly 16 and the movement of the forced air assembly 100 such that heated air is directed only to those portions of the textile substrate 19 containing printed indicia 140. In one embodiment, information regarding the location of indicia 140 on the textile substrate 19 may be used in conjunction with information from the sensors 110 related to a moisture level of the textile substrate 19 to control movement of the forced air assembly 100 relative to the textile substrate 19 carried on the platen assembly 16 such that heated air is directed the toward portions of the print area 142 remaining to be cured. In another embodiment, operation of the forced air assembly 100 described above may be used in connection with a platen assembly 16 configured to draw air through the textile substrate 19 using vacuum pressure in a manner that facilitates effective and efficient drying and/or curing of textile substrates 19 while avoiding excessively heating or scorching the textile substrate 19.

In use, a textile substrate 19, such as a T-shirt or other garment, may be placed on the substrate support 18 of a platen assembly 16 positioned on the base 12 of the machine 10 to receive pretreatment liquid. If the platen assembly 16 is a vacuum platen assembly as described above, the vacuum pressure may be activated to tightly draw the textile substrate 19 against the substrate support 18. The machine 10 may then be activated, whereafter the controller 30 actuates movement of the platen assembly 16 along the bed 14 in the conveying direction 20. As the platen assembly 16 is moved beneath the header assembly 22, the controller 30 actuates the solenoid valve of the nozzle body 50 to dispense pretreatment liquid to the pretreatment area 60 of the textile substrate 19. The controller 30 also actuates the stepper motor 54 to modulate pivotal movement of the nozzle body 50 as the liquid pretreatment is dispensed. The controller 30 may control the pivotal movement of the nozzle body 50 and/or the speed of movement of the platen assembly 16 relative to the nozzle body 50 based at least in part on a relative height of the nozzle body 50 above the base 12. In some embodiments, a color detecting sensor 66 may detect a color of the textile substrate 19 on the substrate support 18, and the controller 30 may use information related to the detected color to select a pretreatment liquid to be applied to the textile substrate 19. When the platen assembly 16 is a vacuum platen assembly as described above, the vacuum pressure created by the vacuum platen draws air through the textile substrate 19 as the pretreatment liquid is applied, thereby reducing or eliminating overspray of liquid pretreatment.

As the platen assembly 16 continues to move along the conveying direction 20 beneath the header assembly 22, the controller 30 actuates the lift motor 74 to move the tamping bar assembly 70 from the second position spaced above the textile substrate 19 toward the first position for engagement with the portions of the textile substrate 19 that have received pretreatment liquid. The uniform pressure applied to the pretreated textile substrate 19 by the tamping bar assembly 70 as the platen assembly 16 moves along the conveying direction 20 smooths the surface of the textile substrate 19, and flattens down and smooths textile fibers of the substrate 19. After passing the tamping bar assembly 70, the pretreated textile substrate 19 is then dried by the forced air assembly 100. Using information from the one or more sensors 110 of the forced air assembly 100, the controller 30 controls forward and/or backward movement of the platen assembly 16 in directions parallel to the conveying axis 20, together with movement of the forced air assembly 100 in directions transverse to the conveying axis 20 to direct heated air toward an area of the textile substrate 19 corresponding to the pretreatment area 60. Advantageously, the controller 30 can control movement of the platen assembly 16 and/or forced air assembly 100 to direct heated air toward portions of the textile substrate 19 having relatively higher moisture content in order to promote efficient and effective drying of the pretreatment liquid on the textile substrate 19. Moreover, when the platen assembly 16 is a vacuum platen assembly as described above, the vacuum pressure created by the vacuum platen draws air through the textile substrate 19. The air flowing though the substrate facilitates efficient drying and helps to avoid excessive heating of the substrate 19.

After the pretreated textile substrate 19 has been dried, the textile substrate 19 may be moved to a digital printer where inks can be applied to the pretreated area 60 of the textile substrate 19 in order to create various indicia 140, as may be desired. In some embodiments, the textile substrate 19 can remain on the platen assembly 16 for transfer to and printing by the digital printer, while in other embodiments the textile substrate 19 can be removed and placed on a separate platen for processing in the digital printer. After the textile substrate 19 has received printed indicia 140, the substrate 19 may be returned to the machine 10 for curing of the inks by the forced air assembly 100 as described above.

While the present invention has been illustrated by a description of various embodiments, and while these embodiments have been described in considerable detail, it is not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

What is claimed is:

1. A machine for processing textile substrates used in digital printing operations, the machine comprising:

a base configured to receive a substrate support adapted to support textile substrates;

a header assembly supported above the base;

a conveying actuator configured to impart relative movement between the header assembly and the substrate support received on the base along a first axis aligned with a conveying direction of the machine;

a forced air assembly supported above the base for movement along at least a second axis transverse to the conveying direction;

a controller configured to control at least one of the relative movement between the substrate support and the header assembly along the conveying direction, or the movement of the forced air assembly along at least the second axis based on information related to at least one of a pretreatment area or a print area of the textile substrate, such that heated air from the forced air assembly is directed onto an area of the textile substrate substantially corresponding to at least one of the pretreatment area or the print area; and at least one sensor disposed above the base and configured to sense a characteristic of the textile substrate supported on the substrate support related to a moisture level of the pretreatment area;

the controller further configured to control at least one of the relative movement between the substrate support and the header assembly along the conveying direction, or the movement of the forced air assembly along the at least one second axis based on the characteristic sensed by the at least one sensor.

2. The machine of claim 1, wherein the substrate support comprises a platen assembly configured to draw the textile substrate against a support surface thereof by vacuum pressure.

3. The machine of claim 1, further comprising:

an image sensor disposed above the base and configured to detect indicia applied to the textile substrate supported on the substrate support;

wherein the controller is configured to control at least one of the relative movement between the substrate support and the header assembly, or the movement of the forced air assembly based on information related to the detected indicia such that heated air from the forced air assembly is directed onto areas of the textile substrate substantially corresponding to the location of the detected indicia.

4. The machine of claim 1, further comprising:

an image sensor disposed above the base and configured to detect the pretreatment area of the textile substrate supported on the substrate support;

wherein the controller controls at least one of the relative movement between the substrate support and the header assembly, or the movement of the forced air assembly based on information related to the detected pretreatment area.

5. The machine of claim 1, further comprising:

a nozzle supported on the header assembly above the base, the nozzle configured to apply pretreatment liquid to the pretreatment area of the textile substrate supported on the substrate support.

6. The machine of claim 5, wherein the controller controls at least one of the relative movement between the substrate support and the nozzle, or the movement of the forced air assembly such that heated air from the forced air assembly is directed onto wet portions of the pretreatment area.

7. The machine of claim 5, further comprising:

a tamping bar assembly disposed behind the nozzle with respect to the conveying direction, and above the base;

the tamping bar assembly movable between a first position wherein the tamping bar assembly engages the textile substrate supported on the substrate support, and a second position spaced a distance above the textile substrate.

8. The machine of claim 7, wherein the tamping bar assembly is biased in a direction toward the textile substrate supported on the substrate support.

9. The machine of claim 7, wherein the tamping bar assembly comprises:

a resilient foam member disposed for engagement with the textile substrate supported on the substrate support when the tamping bar assembly is in the first position.

10. The machine of claim 9, wherein the tamping bar assembly further comprises a film layer disposed on the foam member and configured to engage the textile substrate supported on the substrate support when the tamping bar assembly is in the first position.

11. The machine of claim 5, wherein the nozzle is supported above the base for pivotal movement about an axis such that liquid material dispensed from the nozzle may be adjusted in directions transverse to the conveying direction of the machine.

12. The machine of claim 11, wherein:

the nozzle is further supported above the base for movement in directions toward or away from the base;

the machine further comprises a height sensor configured to detect a distance of the nozzle above the substrate support; and the controller is configured to control the relative movement between the substrate support and the header assembly based on information related to the detected distance.

* * * * *